US008167029B2

(12) United States Patent
Bertilsson et al.

(10) Patent No.: US 8,167,029 B2
(45) Date of Patent: May 1, 2012

(54) PLATE HEAT EXCHANGER

(75) Inventors: Klas Bertilsson, Eslov (SE); Marcello Pavan, Lonigo (IT); Alvaro Zorzin, Romans D'isonzo (IT); Loris Sartori, Alonte (IT)

(73) Assignee: Alfa Laval Corporate AB (SE)

( * ) Notice: Subject to any disclaimer, the term of this patent is extended or adjusted under 35 U.S.C. 154(b) by 995 days.

(21) Appl. No.: 11/911,074

(22) PCT Filed: Apr. 12, 2006

(86) PCT No.: PCT/SE2006/000436

§ 371 (c)(1), (2), (4) Date: Mar. 11, 2008

(87) PCT Pub. No.: WO2006/110090

PCT Pub. Date: Oct. 19, 2006

(65) Prior Publication Data

US 2008/0196874 A1 Aug. 21, 2008

(30) Foreign Application Priority Data

Apr. 13, 2005 (SE) ..... 0500816

(51) Int. Cl.
*F28F 9/02* (2006.01)

(52) U.S. Cl. ..... 165/167; 165/174

(58) Field of Classification Search ..... 165/166, 165/167, 174

See application file for complete search history.

(56) References Cited

U.S. PATENT DOCUMENTS

| | | | | | |
|---|---|---|---|---|---|
| 2,392,444 | A | * | 1/1946 | Amand et al. | 165/150 |
| 2,617,634 | A | * | 11/1952 | Jendrassik | 165/140 |
| 3,460,611 | A | * | 8/1969 | Salvatore et al. | 165/166 |
| 4,073,340 | A | * | 2/1978 | Parker | 165/166 |
| 4,134,195 | A | * | 1/1979 | Jacobsen et al. | 29/890.038 |
| 4,246,962 | A | * | 1/1981 | Norback | 165/166 |
| 4,398,596 | A | * | 8/1983 | Lauro et al. | 165/167 |
| 4,470,455 | A | | 9/1984 | Sacca | |
| 4,974,670 | A | | 12/1990 | Noguchi | |
| 5,924,484 | A | | 7/1999 | Andersson et al. | |
| 5,971,065 | A | * | 10/1999 | Bertilson et al. | 165/166 |
| 2002/0050347 | A1 | * | 5/2002 | Hainley et al. | 165/167 |
| 2005/0082049 | A1 | | 4/2005 | Brost | |

FOREIGN PATENT DOCUMENTS

| | | |
|---|---|---|
| DE | 3600656 | 7/1987 |
| DE | 10024888 | 11/2001 |
| EP | 0271084 | 6/1988 |
| EP | 1001240 | 5/2000 |
| GB | 134277 | 10/1919 |
| SE | 8702608 | 12/1988 |
| WO | 95/00810 | 1/1995 |
| WO | 97/15797 | 5/1997 |

OTHER PUBLICATIONS

International Search Report for PCT/SE2006/000436.

* cited by examiner

*Primary Examiner* — Allen Flanigan
(74) *Attorney, Agent, or Firm* — Fish & Richardson P.C.

(57) ABSTRACT

The invention relates to a plate heat exchanger (1) having a package of heat transfer plates (2), which are provided with through inlet ports (10) forming an inlet channel (12) through the package, and between the heat transfer plates arranged sealing means, which together with the heat transfer plates in every other plate interspace delimit a first flow passage (14) for one fluid and in each of the remaining plate interspaces delimit a second flow passage (13) for a second fluid, wherein the inlet channel (12) communicates with each first flow passage (14) by way of a first inlet passage (15), and is sealed from communication with each second flow passage by the sealing means.

11 Claims, 4 Drawing Sheets

PLATE HEAT EXCHANGER

FIELD OF THE INVENTION

The present invention relates to plate heat exchanger comprising a package of heat transfer plates, which are provided with through inlet ports forming an inlet channel through the package, and between the heat transfer plates arranged sealing means, which together with the heat transfer plates in every other plate interspace delimit a first flow passage for one fluid and in each of the remaining plate interspaces delimit a second flow passage for a heating fluid, wherein said inlet channel communicates with each first flow passage by way of an inlet passage, and is sealed from communication with each second flow passage by said sealing means.

BACKGROUND OF THE INVENTION

Plate heat exchangers are frequently used as evaporators for evaporation of refrigerants circulated in refrigeration systems. Normally, such a refrigeration system comprises a compressor, a condenser, an expansion valve and an evaporator, all of which are coupled in series. In a plate heat exchanger which, is used as an evaporator in a system of this kind the plates are often brazed or welded together. However, gaskets may also be used as a sealing means between adjacent heat transfer plates.

A problem which arises in connection with a refrigeration system of the above referenced type, is that refrigerant entering the inlet channel of the plate heat exchanger is not evenly distributed to the different evaporation flow paths in the interspaces between the heat transfer plates. One reason for this may be that the refrigerant, after having passed through the expansion valve, is already partly evaporated when it enters the inlet channel, and does not remain in the state of a homogenous liquid/vapour mixture during the passage along the whole of the inlet channel, but tends to partly separate into streams of liquid and vapour, respectively.

Uneven distribution of refrigerant to the different evaporation flow paths in the plate heat exchanger results in ineffective use of parts of the plate heat exchanger. Moreover, the refrigerant may become unnecessarily overheated. Furthermore, some channels may be flooded by liquid refrigerant and there is also a risk that some liquid may be present at the outlet.

In order to avoid the problem of uneven distribution of the refrigerant in a plate heat exchanger of the above mentioned type it has previously been suggested in SE 8702608-4 to arrange a restriction means in each passage between the inlet channel of the plate heat exchanger and each plate interspace forming an evaporation flow path for the refrigerant. The restriction means could be a ring or a washer provided with a hole and being arranged between adjacent pairs of the heat transfer plates around the port hole. Alternatively, the restriction means could be a pipe provided with multiple holes or apertures and being arranged in the inlet channel of the plate heat exchanger. As a further alternative it has also been suggested in SE 8702608-4 to create restriction means as an integral part of the heat transfer plates by folding the plate edge portions delimiting the inlet ports of two adjacent heat transfer plates to abutment against each other, edge to edge. In a small area however, inlet openings are formed allowing refrigerant to pass into the flow paths between adjacent plates.

Plate heat exchangers provided with restriction means of the above mentioned kind give rise to several difficulties during the manufacture thereof. The use of separate rings or washers has resulted in problems with the location of the rings or washers in the correct positions when a plate heat exchanger is assembled. A restrictions means in the form of a pipe has the disadvantage that it must have a length adapted to the number of heat transfer plates included in the plate heat exchanger and it must also be correctly positioned in relation to the inlet passages leading into the flow paths between the heat transfer plates. Folding of port edge portions of the plates has also been shown to be unpractical, depending on the fact that it is difficult to obtain well defined inlet openings leading into the plate interspaces as proposed in SE 8702608-4.

Another solution to the problems encountered in connection with uneven distribution of refrigerant to the different evaporation flow paths in the plate heat exchanger, is to provide a well defined inlet passage for restriction of the incoming medium. Plate heat exchangers with such restriction means are disclosed in WO 95/00810 and WO 97/15797.

In the plate heat exchangers according to WO 95/00810 and WO 97/15797, the inlet and outlet channels along the plate package forms ducts with walls having successive peaks and valleys. This particular shape of the channel along the plate package, however, has a disadvantageous impact on the flow of the fluids forcing the fluid to contract and expand, resulting in turbulence and backflows, influencing the quantity and quality of the refrigerant mixture entering the flow paths between adjacent plates and causing pressure drop. Specifically, this is very critical for the refrigerant inlet channel along the plate package, as it negatively influences the distribution of the refrigerant along the plate package.

Ideally, the distribution of refrigerant along the plate package should assure equal mass flow rate with the same vapour quality of refrigerant in each and every refrigerant channel between the heat transfer plates. However, in reality it is quite difficult to achieve such performance since the physical and flow dynamic conditions of the fluid change as the fluid proceeds along the plate package.

SUMMARY OF THE INVENTION

The object of the present invention is to eliminate or at least alleviate the above referenced drawbacks and to provide a plate heat exchanger, which is easy and cost effective to manufacture and in which the heat transfer plates are formed such that an improved and even distribution of a refrigerant or other liquid to be evaporated may be obtained to the various evaporation flow paths between the heat transfer plates.

According to the invention this object has been achieved by a plate heat exchanger of the initially mentioned kind, which is characterized in that the inlet channel has an essentially smooth cylindrical shape formed by a sealing member provided in the inlet ports for the first fluid and that the inlet passage is provided in the sealing member.

By the present invention a plate heat exchanger may be provided which is easy and cost efficient to manufacture and assemble, and in which the heat transfer plates are formed such that an improved and even distribution of refrigerant or other liquid intended to be evaporated can be obtained to the different evaporation flow paths between the heat transfer plates.

Especially, by the smooth inlet channel having an essentially cylindrical shape according to the invention an improved and very effective utilization of the plate heat exchanger is obtained, wherein turbulence, liquid separation, liquid accumulation and backflow have been substantially decreased resulting in an increased thermal performance of the plate heat exchanger and inducing higher stability, also at part load.

In a preferred embodiment of the invention the port has a smaller diameter and the plate material around the port has been formed such that the heat transfer plates abut closely against each other along the edge of the port, the heat transfer plates forming a first outer sealing area and a second inner sealing area, which close the second flow passage and first flow passage.

In another preferred embodiment of the invention the heat transfer plates are provided with additional ports forming a distribution channel through the package, and the inlet passage interconnects the inlet channel with said distribution channel, and the heat transfer plates are provided with at least one second inlet passage connecting the distribution channel with said first flow passage between the heat transfer plates.

In yet another embodiment of the invention said first and second inlet passages are dimensioned so that they form throttled communications between the inlet channel and the distribution channel and between the distribution channel and said first flow passages, respectively In a preferred embodiment of the invention said first inlet passage is formed by and between adjacent heat transfer plates abutting against each other, a recess or groove being formed in at least one of such adjacent heat transfer plates.

In yet another embodiment of the invention the sealing member is a collar and preferably the collar is an integral part of the port. In another preferred embodiment of the invention opposing edge portions of the collars abut against each other.

In a further embodiment of the invention opposing edge portions of the collars form a slot between them by means of a distance of >0 mm.

In yet a further embodiment two adjacent heat transfer plates have inlet ports with different diameters and the heights of the collars are such that said opposing edge portions of the collars overlap. Preferably the angle between the inlet port and the collar is ≧90°, and most preferably the angle is 90°. Furthermore, according to one embodiment of the invention a chamber is created in the interspace immediately behind the collar.

In yet another preferred embodiment of the invention the sealing member is a ring provided around the inlet port in the interspace between two adjacent heat transfer plates, said ring having at least one pair of opposing recesses extending radially from the inner circumference to the outer circumference of the ring and that the inlet passage is provided by the recesses of two adjacent rings receiving the inlet passage therein. Preferably, said recesses have a shape corresponding to the shape of the first inlet passage.

Other objects, features, advantages and preferred embodiments of the present invention will become more apparent from the following detailed description when taken in conjunction with the drawings and the appended claims.

BRIEF DESCRIPTION OF THE DRAWINGS

Preferred embodiments of the invention will now be described in more detail below, reference being made to the accompanying drawings, in which.

DETAILED DESCRIPTION OF EMBODIMENTS OF THE INVENTION

Figure 1:
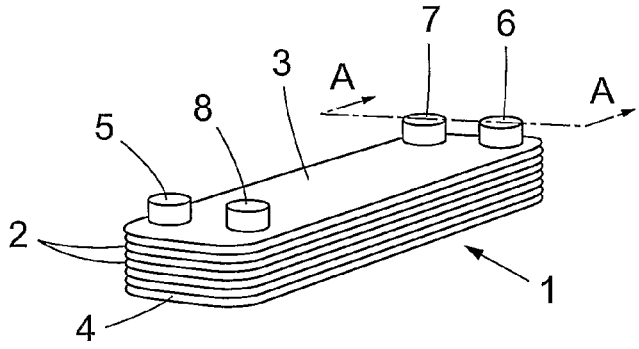
FIG. 1 shows a perspective view of a plate heat exchanger.

In FIG. 1 a conventional single circuit plate heat exchanger 1 is shown which is designed to be used as an evaporator in a cooling system. The plate heat exchanger 1 comprises a number of heat transfer plates 2, which are provided on top of each other between the upper, outer cover plate 3 and the lower, outer cover plate 4, and which are permanently joined by brazing, gluing or welding. Preferably, the heat transfer plates 2 are provided with a corrugation pattern of parallel ridges extending such that the ridges of adjacent heat transfer plates 2 cross and abut against each other in the plate interspaces. Furthermore, the plate heat exchanger 1 has first and second inlets 5 and 6, and first and second outlets 7 and 8, for two heat exchange fluids.

The number of heat transfer plates may of course vary with respect to the desired heat transfer capacity of the plate heat exchanger. During joining by means of brazing a suitable number of heat transfer plates are piled on each other with a solder in the shape of a thin sheet, disc or paste located between adjacent heat transfer plates, and subsequently the whole package is heated in an oven until said solder melts.

During assembly of openable plate heat exchanger a suitable number of plates are piled on each other with a sealing, in the shape of rubber gaskets or similar, located between adjacent plates, and subsequently the whole package is clamped together by means of e g bolts.

Figure 2:
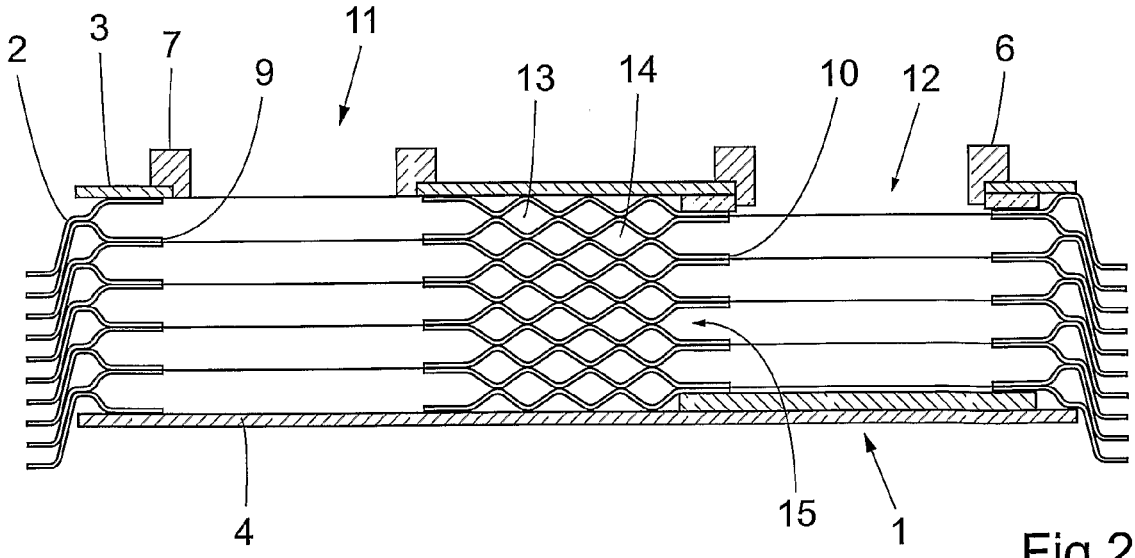
FIG. 2 shows a cross section through a conventional plate heat exchanger along the line A-A in FIG. 1.

In FIG. 2 a cross section through the plate heat exchanger in FIG. 1 is shown, extending along the part of the plate heat exchanger comprising the second inlet connection 6 and the first outlet connection 7.

The heat transfer plates 2 are further provided with a through port 9 and at a small distance therefrom, an additional port 10. The respective ports 9 and 10 on the plates are aligned with each other, such that the ports 9 form an outlet channel 11 and the ports 10 form an inlet channel 12 extending through the plate package. The outlet channel 11 is at one end connected to the outlet connection 7 for a second heat exchange fluid and an inlet channel 12 is connected to the inlet connection 6 for a first heat exchange fluid.

The plate heat exchanger 1 is in a conventional manner provided with sealing means between the heat transfer plates 2, which together with the respective heat transfer plates in every second plate interspace delimit a second flow passage 13 for said second heat exchange fluid and in the remaining plate interspaces delimit a first flow passage 14 for said first heat exchange fluid. The second flow passage 13 is connected to the outlet channel 11 by means of at least one inlet passage 15 between the ports of two heat transfer plates abutting each other. Each first flow passage 14 communicates with the inlet channel 12 in the same way.

The plate heat exchanger in FIGS. 1 and 2 is provided with one outlet channel 11 and one inlet channel 12 for each of the two heat transfer fluids, and said channels are located in the end portions of the heat transfer plates 2. Of course, the plate heat exchanger may be provided with several inlet and outlet channels, whereas the shape and location of the channels may be freely chosen. For instance, the plate heat exchanger may be a dual circuit heat exchanger for three different fluids having six ports.

Figure 3:
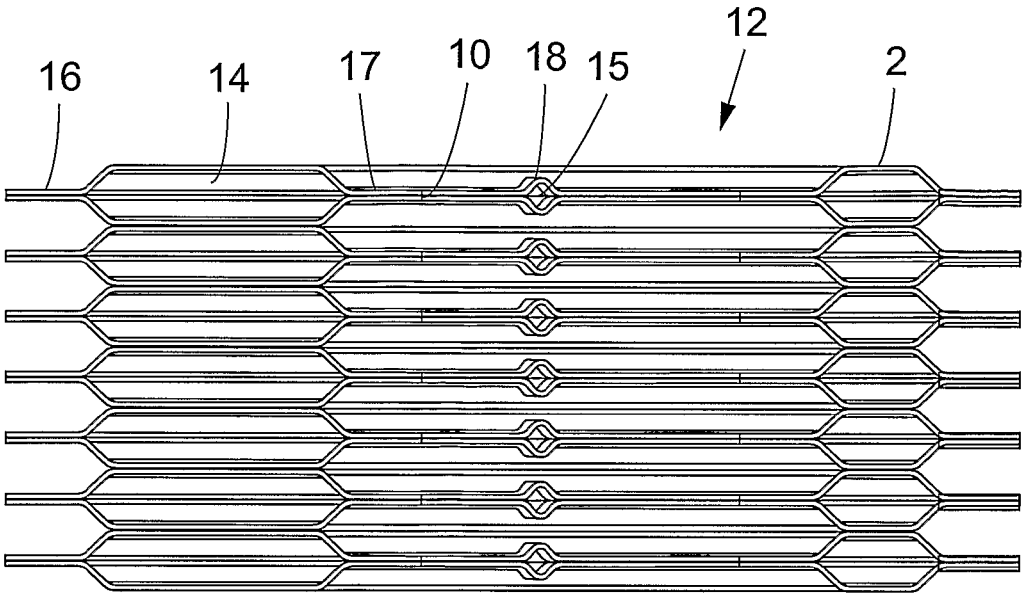
FIG. 3 shows a cross section of an inlet channel of a plate heat exchanger provided with a previously known distribution means creating an uneven channel through the plate heat exchanger.

FIG. 3 shows an inlet channel 12 of a plate heat exchanger 1 provided with a previously known distribution means. The heat transfer plates 2 are provided with a contraction of the inlet channel 12 in comparison with the inlet channel 12 shown in FIG. 2. Accordingly, the port 10 has a smaller diameter and the plate material around the port 10 has been formed such that the heat transfer plates 2 abut closely against each other along the edge of the port 10. By this construction the heat transfer plates 2 forms a first outer sealing area 16 and a second inner sealing area 17, which close the second flow passage 13 and first flow passage 14, respectively. The second sealing area 17 is an essentially flat annular area around the inlet ports 10.

Communication between the first flow passage 14 and the inlet channel 12 is provided by an inlet passage 15. The second inner sealing area 17 in at least one of the two plates, on its side facing the other plate, may be provided with at least one narrow recess or groove 18, leaving the two plates without abutment or interconnection at this part of the inner sealing area 17. This means that said groove 18 forms the first inlet passage 15 connecting the inlet channel 12 with the first flow passage 14. In FIG. 3 the inlet passage 15 is formed as a duct, which is created by opposing grooves provided in each of two adjacent heat transfer plates 2 facing each other along the edge of the port 10.

However, this construction creates an uneven channel through the plate heat exchanger, which is shown in FIG. 3. The inner sealing area 17 creates an uneven inlet channel 12 which gives rise to the above stated problems.

Figure 4:
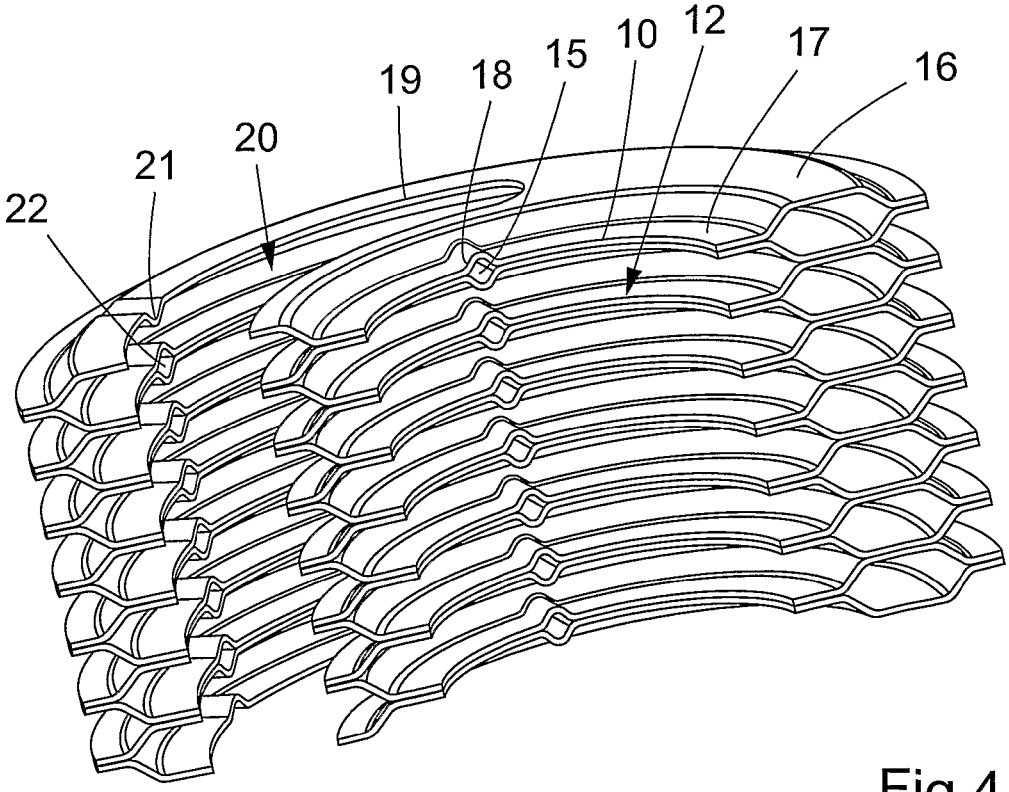
FIG. 4 shows a perspective cross section of an inlet channel of a plate heat exchanger provided with a second previously known distribution means creating an uneven channel through the plate heat exchanger.

FIG. 4 shows an inlet channel 12 of another plate heat exchanger 1 provided with a second previously known distribution means also creating an uneven channel through the plate heat exchanger. Each of the heat transfer plates 2 is provided with a first port 10 and at a small distance, a second port 19. All first ports 10 are aligned and form an inlet channel 12 extending through the plate package and all second ports 19 are also aligned and form a distribution channel 20 extending in parallel with the inlet channel 12 through the plate package.

In an alternative embodiment a second groove 21 forms a second inlet passage 22 connecting the distribution channel 20 with the first flow passage 14 formed between the two adjacent heat transfer plates 2.

Figure 5:
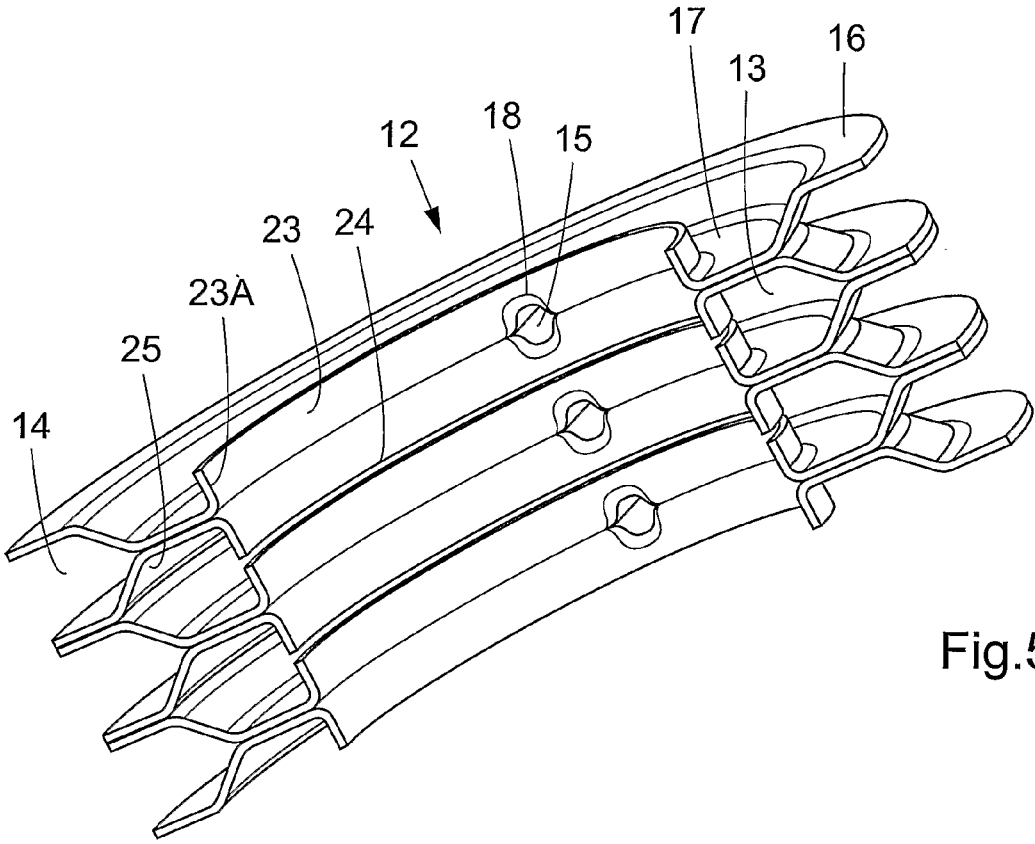
FIG. 5 shows a perspective view of the inlet channel of a plate heat exchanger provided with a smooth channel according to one embodiment of the present invention.

FIG. 5 shows a first embodiment of the invention, wherein a plate heat exchanger 1 is provided with a sealing member 23 in the form of a collar 23A in the port 10 of the heat transfer plates 2. Preferably the angle between the collar 23A and the port is 90°. By the collar 23A a smooth inlet channel 12 is created having an essentially cylindrical shape.

A distance may be provided between the edges of two collars 23A of adjacent plates, the edges facing each other, said distance forming a slot 24. The distance may be chosen in accordance with the pressing depth of the heat transfer plate in order to minimize the gap of the slot 24. The smaller the gap is, the more the channel resembles a smooth cylindrical pipe.

In order to avoid interference between the edges of one collar 23A to the next during the compression of the plate package the height may be chosen such that it does not exceed the pressing depth, i e such that the opposing edge portions of the collars 23A form a slot 24 between them by means of a distance of >0 mm.

Figure 6:
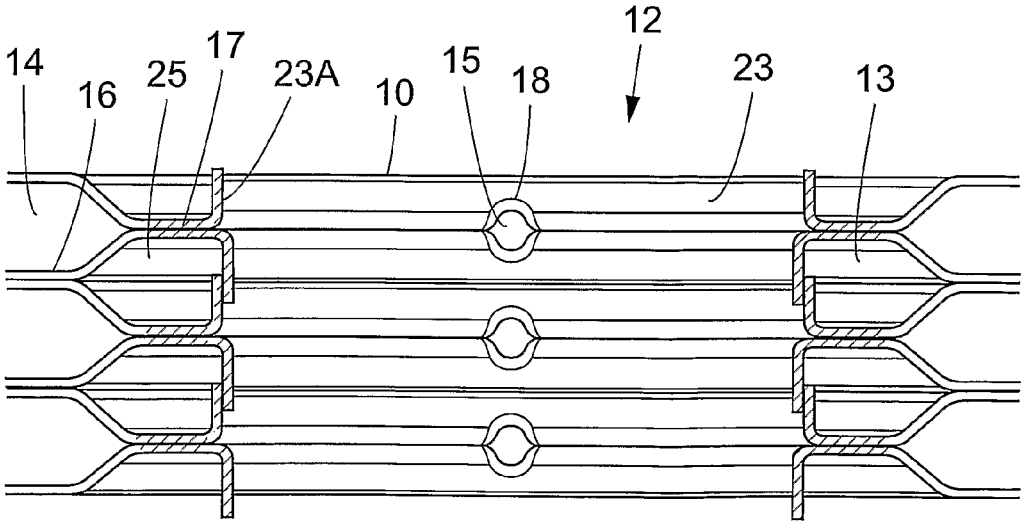
FIG. 6 shows a cross section of the inlet channel of a plate heat exchanger provided with a smooth channel according to another embodiment of the present invention.

However, in FIG. 6 it is shown that it is also possible to avoid interference between the edges by providing two adjacent heat transfer plates having inlet ports 10 with different diameters and choosing the heights of the collars 23A such that said opposing edge portions of the collars 23A overlap. Furthermore, in this latter case, according to the invention the angle between the inlet port 10 and the collar 23A may be >90°.

A chamber 25, created in the interspace immediately behind the collar 23A, may receive refrigerant through the slots 24 and functions as a cell of refrigerant which balances the forces and the momentum due to high pressure. In this way the collar 23A will not be deformed by the pressure of the refrigerant and the inlet channel 12 along the plate package has good mechanical resistance.

In a plate heat exchanger according to one embodiment of the invention an entering flow of refrigerant, or other liquid to be evaporated, is subjected to a first pressure drop and a partial evaporation when passing through the first inlet passage 15, 18 formed between an inlet channel 12 and a distribution channel 20. It then undergoes an equalization of the pressure in the distribution channel before entering, through the second groove 21, the first flow passage 14 formed between the heat transfer plates.

Figure 7:
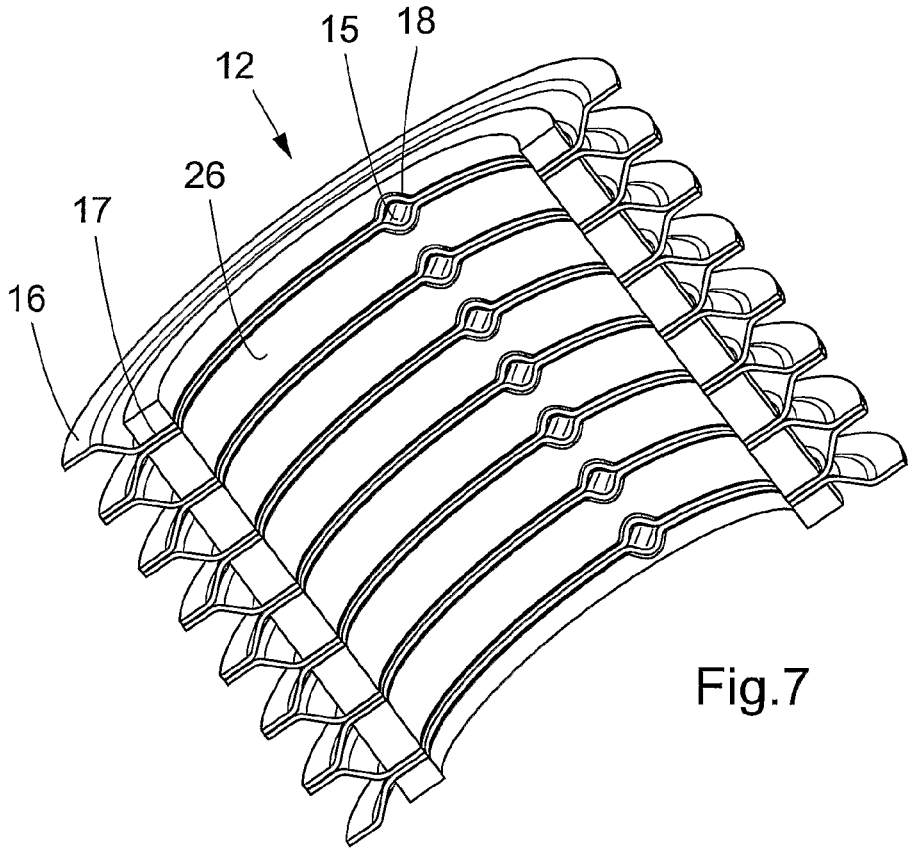
FIG. 7 shows a perspective view of an inlet channel of a plate heat exchanger provided with a smooth channel by means of a ring surrounding the port hole according to yet another embodiment of the present invention.
Figure 8:
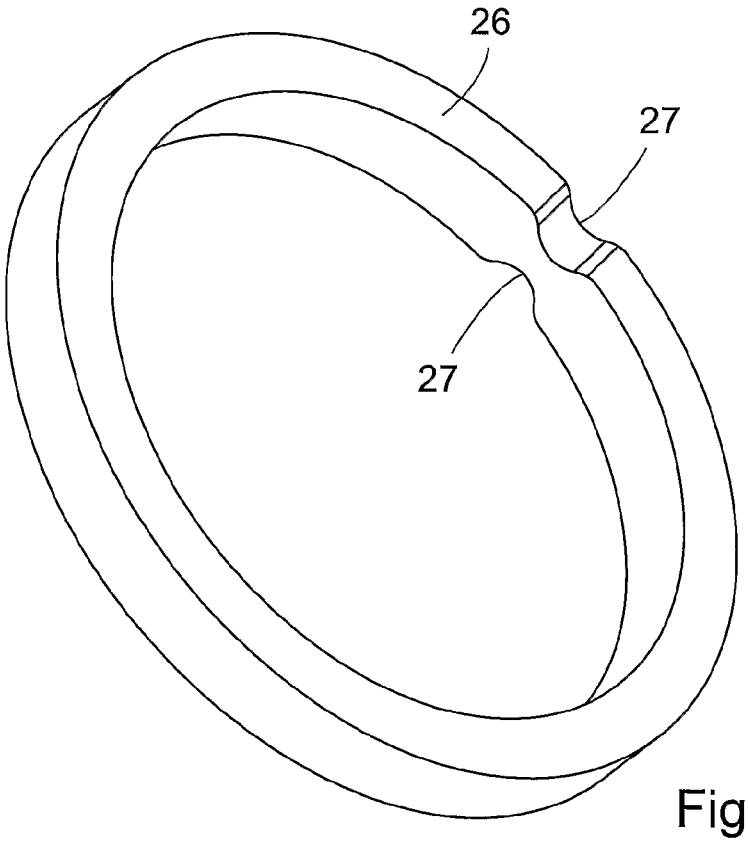
FIG. 8 shows a perspective view of the ring in FIG. 7 according to the invention.

Another alternative embodiment of the present invention is shown in FIG. 7 and FIG. 8, wherein the sealing member 23 is a ring 26 which has been inserted between two adjacent heat transfer plates 2 around the port 10, in the interspace between two adjacent heat transfer plates. The ring 26 has at least one pair of opposing recesses 27 extending radially from the inner circumference to the outer circumference of the ring. Said recesses correspond to the shape of the inlet passage 15, e g one or several grooves 18 in the second sealing area 17 of two abutting heat transfer plates 2 forming the first inlet passage 15. The ring 26 is provided around the inlet port 10 in the interspace between two adjacent heat transfer plates, and the inlet passage 15 is provided by the recesses 27 of two adjacent rings receiving the inlet passage 15 therein. The ring has a smooth inner surface and is preferably made of metal or PTFE.

Should a refrigerant be partly evaporated when it enters the inlet channel 12, the present invention keeps the homogeneity of the refrigerant liquid/vapour mixture before it enters the evaporation flow paths formed between the heat transfer plates. Especially, by the smooth inlet channel 12, having an essentially cylindrical shape according to the invention, an improved and very effective utilization of the plate heat exchanger is obtained, wherein turbulence, liquid separation, liquid accumulation and backflow have been substantially decreased resulting in an increased thermal performance of the plate heat exchanger and inducing higher stability, also at part load.

It will be readily apparent to one skilled in the art that various substitutions and modifications may be made to the invention disclosed herein without departing from the scope and spirit of the invention.

The invention claimed is:

1. A plate heat exchanger comprising a package of heat transfer plates, which are provided with through inlet ports forming an inlet channel through the package, and between the heat transfer plates arranged sealing means, which together with the heat transfer plates in every other plate interspace delimit a first flow passage for one fluid and in each of the remaining plate interspaces delimit a second flow passage for a second fluid, wherein the inlet channel communicates with each first flow passage by way of a first inlet passage, and is sealed from communication with each second flow passage by the sealing means, and the inlet channel has an essentially smooth cylindrical shape formed by a sealing member provided in the inlet ports for the first fluid and the first inlet passage is provided in the sealing member, wherein the sealing member is a ring provided around the inlet port in the interspace between two adjacent heat transfer plates, the ring having at least one pair of opposing recesses extending radially from the inner circumference to the outer circumference of the ring and the first inlet passage is provided by the recesses of two adjacent rings receiving the first inlet passage therein.

2. A plate heat exchanger according to claim 1, wherein the port has a smaller diameter and the plate material around the port has been formed such that the heat transfer plates abut closely against each other along the edge of the port, the heat transfer plates forming a first outer sealing area and a second inner sealing area, which close the second flow passage and the first flow passage.

3. A plate heat exchanger according to claim 1, wherein the sealing member is a collar.

4. A plate heat exchanger according to claim 3, wherein the collar is an integral part of the port.

5. A plate heat exchanger according to claim 3, wherein opposing edge portions of the collars abut against each other.

6. A plate heat exchanger according to claim 3, wherein opposing edge portions of the collars form a slot between them by means of a distance of >0 mm.

7. A plate heat exchanger according to claim 6, wherein two adjacent heat transfer plates have inlet ports with different diameters and the heights of the collars are such that said opposing edge portions of the collars overlap.

8. A plate heat exchanger according to claim 3, wherein the angle between the inlet port and the collar is .gtoreq.90.degree.

9. A plate heat exchanger according to claim 3, wherein the angle between the inlet port and the collar is 90.degree.

10. A plate heat exchanger according to claim 3, wherein a chamber is created in the interspace immediately behind the collar.

11. A plate heat exchanger according to claim 1, wherein the recesses have a shape corresponding to the shape of the first inlet passage.

* * * * *

UNITED STATES PATENT AND TRADEMARK OFFICE

CERTIFICATE OF CORRECTION

PATENT NO. : 8,167,029 B2
APPLICATION NO. : 11/911074
DATED : May 1, 2012
INVENTOR(S) : Klas Bertilsson et al.

It is certified that error appears in the above-identified patent and that said Letters Patent is hereby corrected as shown below:

Column 8, line 14 (Claim 8, line 3), delete ".gtoreq.90.degree" and insert -- ≥90°--.

Column 8, line 16 (Claim 9, line 2), "90.degree" and insert -- 90°--.

Signed and Sealed this
Third Day of July, 2012

David J. Kappos

David J. Kappos
*Director of the United States Patent and Trademark Office*